US010092089B1

(12) United States Patent
Yuan et al.

(10) Patent No.: US 10,092,089 B1
(45) Date of Patent: Oct. 9, 2018

(54) HEIGHT-ADJUSTABLE TABLE

(71) Applicant: Chung Chiao Holding Corp., Taipei (TW)

(72) Inventors: Te-Jung Yuan, Taoyuan (TW); Chung-Jong Hsu, Taoyuan (TW)

(73) Assignee: CHUNG CHIAO HOLDING CORP., Taipei (TW)

( * ) Notice: Subject to any disclaimer, the term of this patent is extended or adjusted under 35 U.S.C. 154(b) by 0 days.

(21) Appl. No.: 15/615,482

(22) Filed: Jun. 6, 2017

(51) Int. Cl.

| | |
|---|---|
| ***A47B 9/16*** | (2006.01) |
| ***A47B 3/00*** | (2006.01) |
| ***A47B 21/02*** | (2006.01) |
| ***A47B 21/03*** | (2006.01) |

(52) U.S. Cl.
CPC ..... *A47B 9/16* (2013.01); *A47B 3/002* (2013.01); *A47B 21/02* (2013.01); *A47B 21/0314* (2013.01); *A47B 2021/0335* (2013.01)

(58) Field of Classification Search
CPC ..... A47B 9/16; A47B 2021/035; A47B 2021/0342
USPC ..... 108/144.11, 147; 248/421
See application file for complete search history.

(56) References Cited

U.S. PATENT DOCUMENTS

| | | | | |
|---|---|---|---|---|
| 3,245,366 A * | 4/1966 | Fox | A47B 9/18 | 108/145 |
| 4,148,264 A * | 4/1979 | Caravias | A47B 3/00 | 108/12 |
| 4,273,306 A * | 6/1981 | Chang | A47B 9/16 | 108/145 |
| 4,718,355 A * | 1/1988 | Houghton | A47B 9/16 | 108/147 |
| 4,747,353 A * | 5/1988 | Watt | A47B 9/02 | 108/145 |
| 5,325,794 A * | 7/1994 | Hontani | A47B 3/0911 | 108/115 |
| 7,677,518 B2 * | 3/2010 | Chouinard | A47B 21/02 | 108/10 |
| 8,015,638 B2 * | 9/2011 | Shimada | A47C 19/04 | 108/145 |
| 9,133,976 B2 * | 9/2015 | Lin | F16M 11/24 | |
| 9,681,746 B1 * | 6/2017 | Chen | A47B 9/16 | |
| 2013/0145972 A1 * | 6/2013 | Knox | B60N 3/063 | 108/145 |
| 2015/0272316 A1 * | 10/2015 | Flaherty | A47B 9/16 | 108/116 |

* cited by examiner

*Primary Examiner* — Jose V Chen
(74) *Attorney, Agent, or Firm* — Muncy, Geissler, Olds & Lowe, P.C.

(57) ABSTRACT

A height-adjustable table includes a table top with two support block units, a linkage mechanism including first and second linkages respectively pivotally connected to the support block units, and a lifting control mechanism including first and second sliding tooth racks respectively slidably mounted in respective sliding open chambers of the support block units and respectively pivotally connected to first and second legs of the first and second linkages, two lock mechanisms with center gears thereof meshed with the first and second sliding tooth racks and two operating handles operable to lock/unlock the center gears for allowing the first and second linkages to be extended out or received so as to further adjust the elevation of the table top.

11 Claims, 12 Drawing Sheets

HEIGHT-ADJUSTABLE TABLE

BACKGROUND OF THE INVENTION

1. Field of the Invention

The present invention relates to tables and more particularly, to a height-adjustable table, which comprises a table top with two support block units, a linkage mechanism with first and second linkages thereof respectively pivotally connected to the support block units, and a lifting control mechanism, which comprises first and second sliding tooth racks respectively slidably mounted in respective sliding open chambers of the support block units and respectively pivotally connected to first and second legs of the first and second linkages, two lock mechanisms with center gears thereof meshed with the first and second sliding tooth racks and two operating handles operable to lock/unlock the center gears for allowing the first and second linkages to be extended out or received so as to further adjust the elevation of the table top.

2. Description of the Related Art

Tables are commonly used in offices, home life, schools and workstations/different types of tables, such as computer tables, work tables, office tables, folding tables, dinner tables, etc., are used for different applications. In order to provide users with a larger table top area, in addition to retractable designs, folding collapsible tables are also commercially available for choice. A folding collapsible table can be freely opened or closed. When not in use, the dimension of a collapsed folding collapsible table is significantly reduced and conveniently for delivery and storage. So, folding collapsible tables are widely invited by consumers.

Further, regular commercial tables have fixed length, width and height, and are applicable to people around average height. However, taller or shorter people will feel uncomfortable when using a table designed for people of average height. There are height-adjustable chairs commercially available that fit different sizes of tables. However, due to limited adjusting range, these commercial height-adjustable chairs cannot fit all sizes of tables. When using a chair or table, people usually will condescend to take the existing chair or table without considering height matching. It will be very inconvenient for large size people to use a regular size chair or table.

People spend a lot of time in using tables and chairs in everyday life. Sitting on the seat for a long period of time can easily lead to back and cervical pain, and the heart rate, metabolic rate, insulin efficacy and high cholesterol levels will decline, so that the incidence of cardiovascular disease, depression and diabetes will be significantly increased. In order to reduce the risk of obesity and to improve metabolic problems and cardiovascular disease, the wave of standing at work has been set off in recent years. More important, in addition to making your body healthy, standing at work can also improve work efficiency and productivity. Therefore, height-adjustable tables are created to meet the need of standing at work. Further, commercial tables commonly have a fixed size and do not allow for adjustment. Although folding collapsible tables can be received to reduce the size convenient for delivery and storage. However, conventional tables are not adjustable or not conveniently adjustable to fit people of different body types. Using a table and chair set that does not fit the body type of the user can cause the user to sit with bad posture. Because most commercial tables are not adjustable in height, they are not ergonomically engineered to fit people of different body types and to satisfy different application requirements. An improvement is needed.

Therefore, it is desirable to provide a table that allows easy and rapid adjustment of the elevation of the table top to fit people of different body shapes.

SUMMARY OF THE INVENTION

The present invention has been accomplished under the circumstances in view. It is the main object of the present invention to provide a height-adjustable table, which allows adjustment of the elevation of the table top rapidly and smoothly, ensuring structural stability.

To achieve this and other objects of the present invention, a height-adjustable table comprises a table top, a linkage mechanism and a lifting adjustment mechanism. The table top comprises two support block units arranged on the bottom surface thereof at two opposite lateral sides in a parallel manner. The linkage mechanism comprises first and second linkages respectively pivotally connected to the support block units. The lifting control mechanism comprises first and second sliding tooth racks respectively slidably mounted in respective sliding open chambers of the support block units and respectively pivotally connected to first and second legs of the first and second linkages, two lock mechanisms with center gears thereof meshed with the first and second sliding tooth racks, and two operating handles operable to lock/unlock the center gears for allowing the first and second linkages to be extended out or received to each other so as to further adjust the elevation of the table top.

Further, when forcing the table top downward to receive the first and second linkages of the linkage mechanism or lifting the table top to extend out the first and second linkages of the linkage mechanism, the first and second sliding tooth racks of the lifting control mechanism are moved inward or outward along the respective sliding open chambers of the respective support block units, and the center gears are rotated to move the first and second sliding tooth racks in reversed directions, and thus the displacement stroke of the first and second linkages is reduced by one-half, accelerating the speed of the upward or downward adjustment of the table top. Thus, the user can easily and rapidly adjust the elevation of the table top.

Further, after adjusted the table top to the desired elevation, the user can release the hands from the grips of the respective operating handles, enabling the grips to be biased downwardly to their previous position by the elastic restoring energy of torsion springs and buffer means, and thus, the hook tips of the respective locking members of the operating handles are forced into engagement with the respective center gears of the lock mechanisms of the lifting control mechanism. At this time, the hook tips of the locking members are respectively positioned in the respective retaining notches of the respective base frames of the respective lock mechanisms and upwardly engaged into the respective elongated positioning holes of the respective position-limiting rail blocks of the support block units of the table top to stop the respective center gears from rotation. Since the center gears are respectively engaged with the respective toothed portions of the respective first and second sliding tooth racks, the first and second sliding tooth racks are prohibited from sliding movement along the respective position-limiting rail blocks. Thus, the locked first and second linkages can firmly support the table top in the adjusted position.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
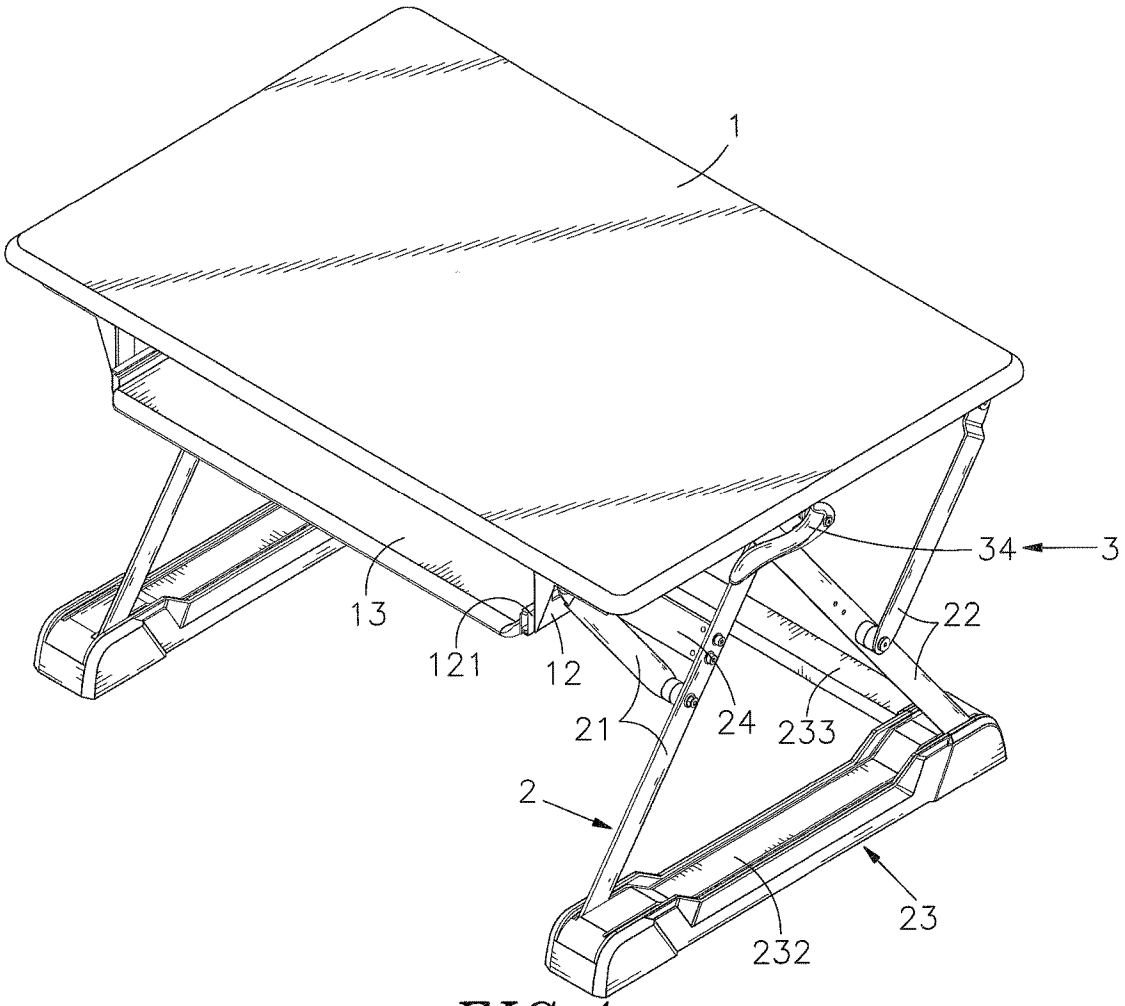
FIG. 1 is an oblique top elevational view of a height-adjustable table in accordance with the present invention.
Figure 2:
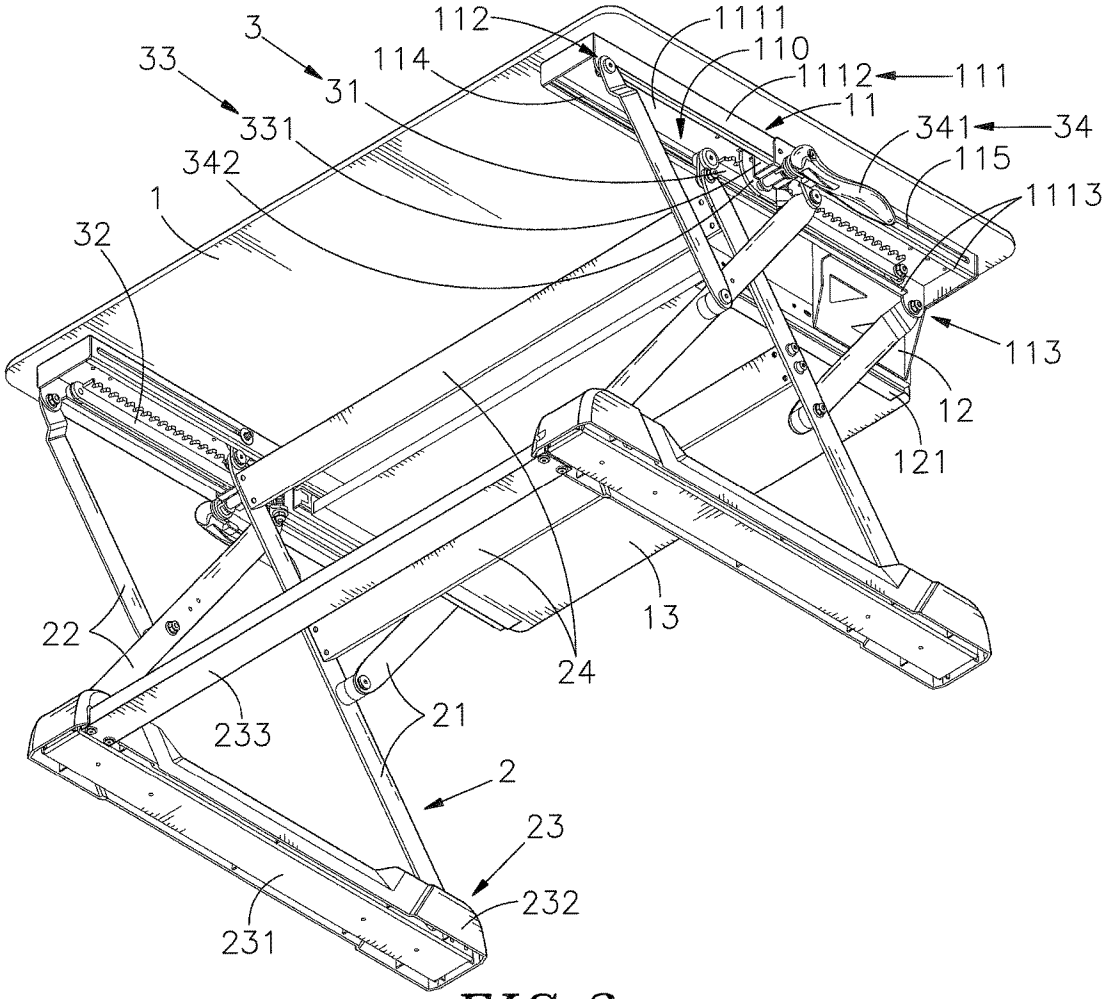
FIG. 2 is an oblique bottom elevational view of the height-adjustable table in accordance with the present invention.
Figure 3:
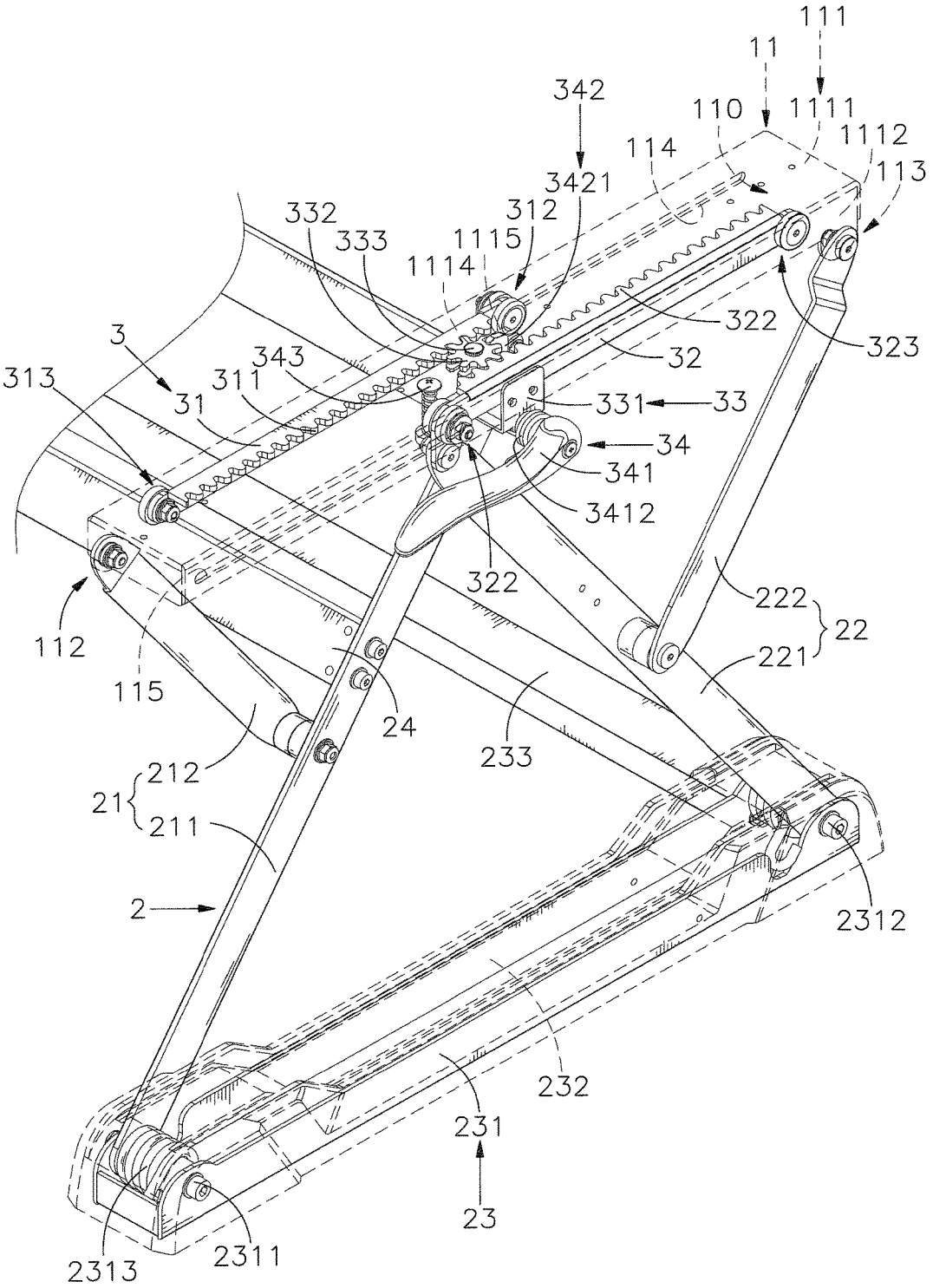
FIG. 3 is a perspective view of a part of the height-adjustable table in accordance with the present invention.
Figure 4:
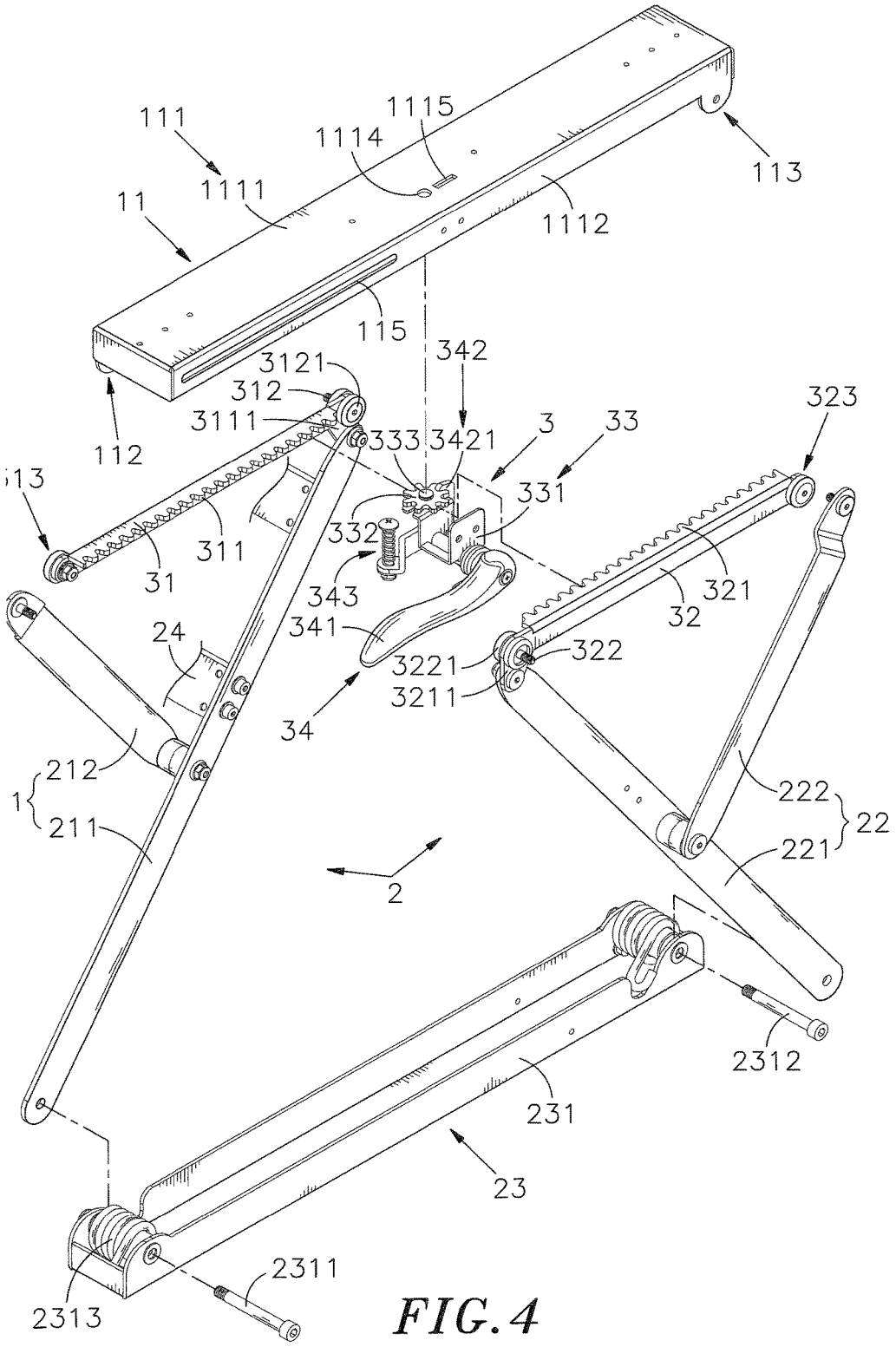
FIG. 4 is an exploded view of a part of the linkage mechanism and lifting control mechanism of the height-adjustable table in accordance with the present invention.
Figure 5:
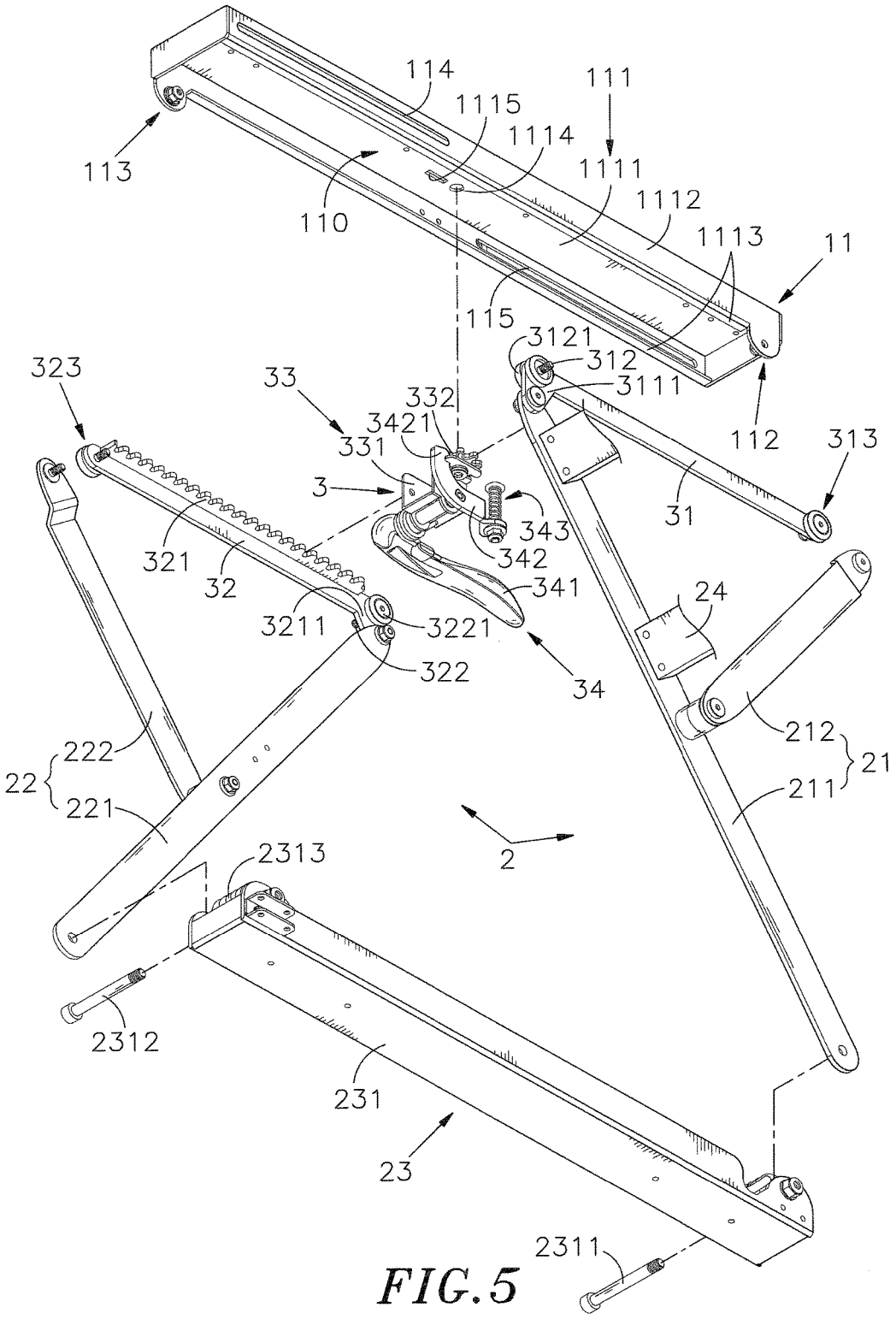
FIG. 5 corresponds to FIG. 4 when viewed from another angle.
Figure 6:
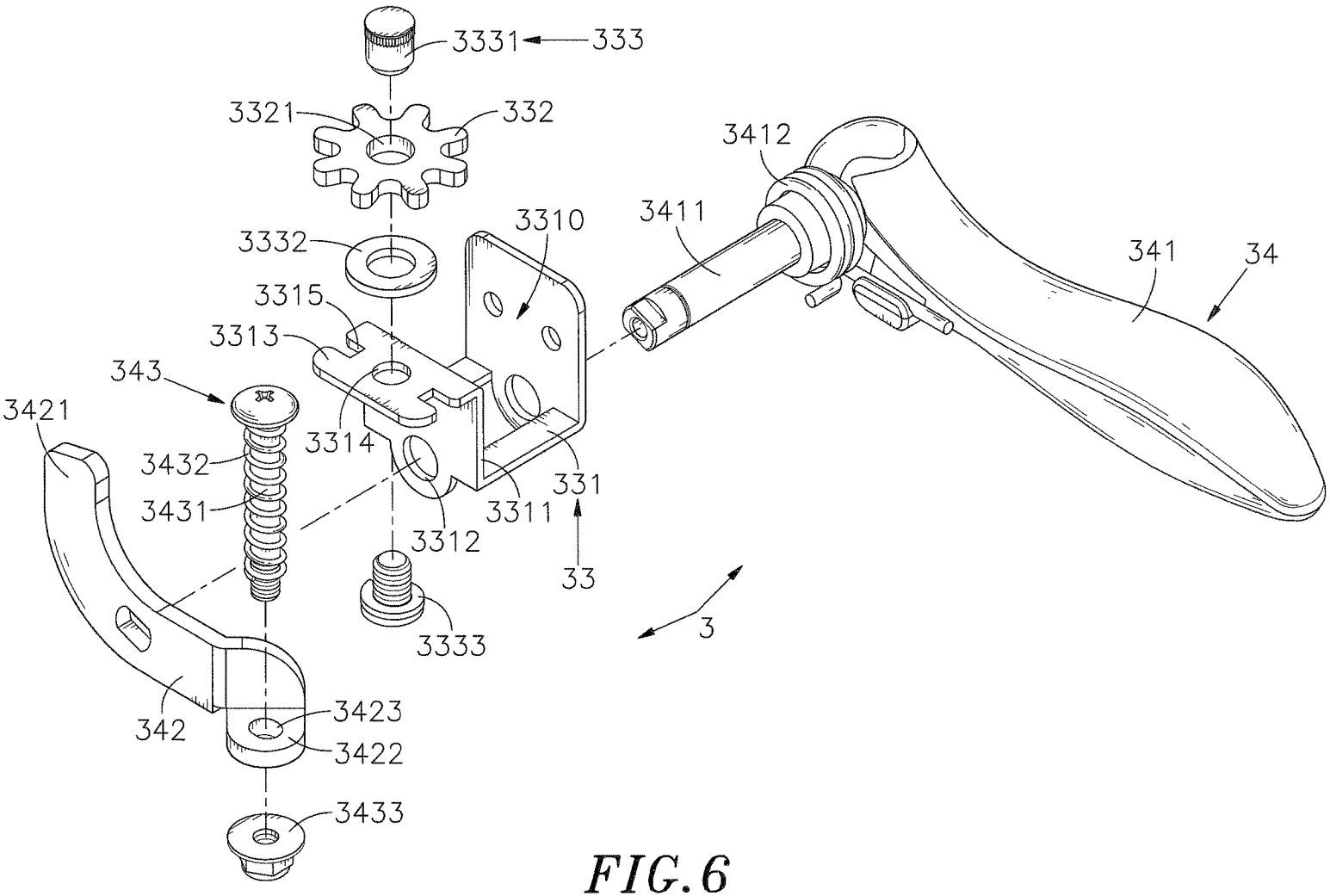
FIG. 6 is an exploded view of one lock mechanism and the associating operating handle of the lifting control mechanism of the height-adjustable table in accordance with the present invention.

Referring to FIGS. 1-6, a height-adjustable table in accordance with the present invention is shown. The height-adjustable table comprises a table top 1, a linkage mechanism 2 and a lifting control mechanism 3.

The table top 1 comprises two support block units 11 located on a bottom surface thereof and respectively extended along two opposite short sides thereof in a parallel manner. Each support block unit 11 comprises a position-limiting rail block 111, which comprises a top panel 1111, two side panels 1112 respectively downwardly extended from two opposite lateral sides of the top panel 1111, two horizontal bottom panels 1113 respectively extended from respective bottom sides of the side panels 1112 in direction toward each other, a mounting through hole 1114 located on the center of the top panel 1111, an elongated positioning hole 1115 cut through the top panel 1111 and disposed adjacent to the mounting through hole 1114 and a sliding open chamber 110 defined by the top panel 1111, the side panels 1112 and the horizontal bottom panels 1113, a first pivot holder 112 and a second pivot holder 113 respectively located at the two side panels 1112 at opposing front and rear sides in a diagonal relationship, and a first sliding slot 114 and a second sliding slot 115 respectively located at the two side panels 1112 and respectively disposed remote from the first pivot holder 112 and the second pivot holder 113 in a diagonal relationship. The table top 1 further comprises two brackets 12 respectively downwardly extended from the position-limiting rail blocks 111 of the support block units 11 at an inner side, and two sliding rails 121 respectively mounted in the two brackets 12 in parallel to the two opposite short sides of the table top 1 and horizontally movable in and out of the respective brackets 12, and a supplementary table top plate 13 mounted on the sliding rail 121 and movable with the sliding rail 121 in and out of the table top 1.

The linkage mechanism 2 comprises two first linkages 21 and two second linkages 22 respectively and symmetrically coupled to the two support block units 11 of the table top 1 at a bottom side. Each first linkage 21 comprises a first leg 211, and a first strut rod 212 pivotally connected with one end thereof to a middle part of the first leg 211 and with an opposite end thereof to the first pivot holder 112 of the one respective support block unit 11. Each second linkage 22 comprises a second leg 221, and a second strut rod 222 pivotally connected with one end thereof to a middle part of the second leg 221 and with an opposite end thereof to the second pivot holder 113 of the one respective support block unit 11. Further, the first leg 211 of each first linkage 21 and the second leg 221 of the adjacent second linkage 22 have respective top ends thereof extended across each other.

The linkage mechanism 2 further comprises two hollow bottom block units 23 respectively coupled with the first linkages 21 and the second linkages 22 at a bottom side in a parallel manner to face toward the respective support block units 11 of the table top 1. Each hollow bottom block unit 23 comprises a hollow bottom block 231, a first pivot axle 2311 and a second pivot axle 2312 respectively and transversely mounted in the opposing front and rear ends of the hollow bottom block 231 and respectively pivotally coupled with an opposing bottom end of the first leg 211 of the one respective first linkages 21 and an opposing bottom end of the second leg 221 of the one respective second linkage 22, two torsion springs 2313 respectively mounted on the first pivot axle 2311 and the second pivot axle 2312 with respective opposite ends thereof respectively stopped against the hollow bottom block 231 and the first leg 211 or the second leg 221, and a cover plate 232 covered on the hollow bottom block 231. The linkage mechanism 2 further comprises a stretcher 233 transversely connected between the hollow bottom blocks 231 of the two hollow bottom block units 23, and at least one, for example, two transverse connection rods 24 connected between the first legs 211 of the first linkages 21 and/or second legs 221 of the second linkages 22. Thus, the first linkages 21, the second linkages 22, the support block units 11 and the hollow bottom block units 23 are combined to create an isosceles linkage mechanism movable to lift or lower the table top 1 in vertical direction.

The lifting control mechanism 3 comprises two first sliding tooth racks 31 and two second sliding tooth racks 32 respectively slidably mounted in the sliding open chambers 110 of the support block units 11 of the table top 1. The first sliding tooth rack 31 and the second sliding tooth rack 32 each comprise a toothed portion 311, 321 located at an inner side and extended along the length thereof, a connection lug 3111, 3211 extended from one end thereof out of the respective support block unit 11 and pivotally connected to the top end of the first leg 211 of the one respective first linkage 21 or the second leg 221 of the one respective second linkage 22, a first guide rod 312 and a second guide rod 322 disposed adjacent to the connection lug 3111, 3211 and slidably inserted through the first sliding slot 114 and the second sliding slot 115 of the position-limiting rail block 111 of the respective support block unit 11, a roller 3121, 3221 rotatably mounted on the first guide rod 312 and the second guide rod 322 and supported inside the position-limiting rail block 111 of the respective support block unit 11, and a rotary member (such as roller or axle bearing) 313, 323 pivotally mounted at an opposite end thereof remote from the first guide rod 312 and the second guide rod 322.

The lifting control mechanism 3 further comprises two lock mechanisms 33 respectively mounted between the first sliding tooth racks 31 and the second sliding tooth racks 32, and an operating handle 34 mounted at each lock mechanism 33. The lock mechanism 33 comprises a base frame 331, a center gear 332 pivotally mounted on the base frame 331. The base frame 331 comprises two upright side walls 3311, an accommodation space 3310 defined between the two upright side walls 3311 for the passing of the respective second sliding tooth rack 32, two first axle holes 3312 respectively located on the upright side walls 3311 near a bottom side thereof, a flat flange 3313 perpendicularly and outwardly extended from a top side of the one upright side wall 3311 to the inside of the position-limiting rail block 111 of the respective support block unit 11, a second axle hole 3314 located on the flat flange 3313 and extended in a direction perpendicular to the extending direction of the first axle hole 3312, and a retaining notch 3315 located on the peripheral edge of the flat flange 3313. Further, one upright side wall 3311 remote from the flat flange 3313 is fastened to an outside wall of the respective support block unit 11. Further, the center gear 332 is meshed with the toothed portions 311, 321 of the first sliding tooth rack 31 and the second sliding tooth rack 32, and rotatable to move the first sliding tooth rack 31 and the second sliding tooth rack 32 in reversed directions. The center gear 332 comprises a center hole 3321 coupled to a pivot connector 333. The pivot connector 333 comprises a cap nut 3331 riveted to the mounting through hole 1114 of the position-limiting rail block 111, a screw 3333 upwardly inserted through the second axle hole 3314 of the base frame 331 and the center hole 3321 of the center gear 332 and fastened up with the cap nut 3331, and a plurality of washers 3332 mounted between the cap nut 3331 and the screw 3333 and abutted at opposing top and bottom sides of the center gear 332.

The operating handle 34 of the lock mechanism 33 comprises a grip 341 suspending outside the support block unit 11 and rotatable in a direction parallel to the longitudinal direction of the support block units 11, a shank 3411 perpendicularly extended from one end of the grip 341 and pivotally coupled to the first axle holes 3312 of the base frame 331, a torsion spring 3412 mounted on the shank 3411 with two opposite ends thereof respectively stopped against the base frame 331 and the grip 341, a locking member 342 fastened to a distal end of the shank 3411 remote from the grip 341 and suspending near the center gear 332 and comprising a hook tip 3421 upwardly curved from one end thereof, a bearing end piece 3422 located at an opposite end thereof and a through hole 3423 cut through the bearing end piece 3422, and buffer means 343, which comprises a headed pusher rod 3431 slidably inserted through the through hole 3423, a screw nut 3433 threaded onto the headed pusher rod 3431 and abutted at a bottom side of the bearing end piece 3422, and a compression spring 3432 mounted on the headed pusher rod 3431 and stopped between the bearing end piece 3422 and the head of the screw nut 3433. The screw nut 3433 of the buffer means 343 is abutted at the bottom surface of the top panel 1111 of the position-limiting rail block 111. Thus, the compression spring 3432 of the buffer means 343 imparts an elastic restoring energy to the locking member 342 to hold the hook tip 3421 in engagement with the center gear 332 and the retaining notch 3315 of the base frame 331, thereby locking the lifting control mechanism 3 in position.

Figure 7:
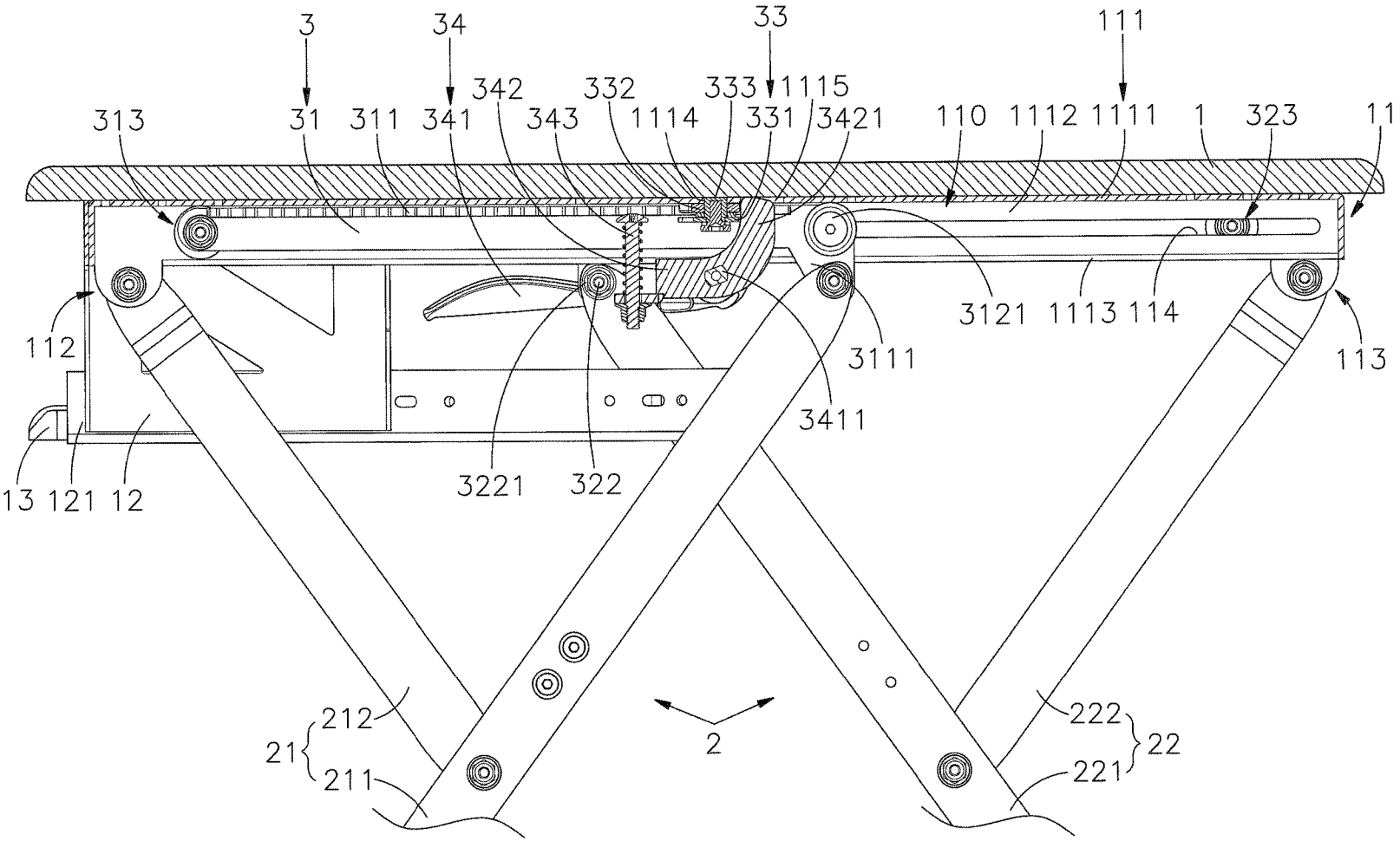
FIG. 7 is a sectional side view of the height-adjustable table in accordance with the present invention.
Figure 8:
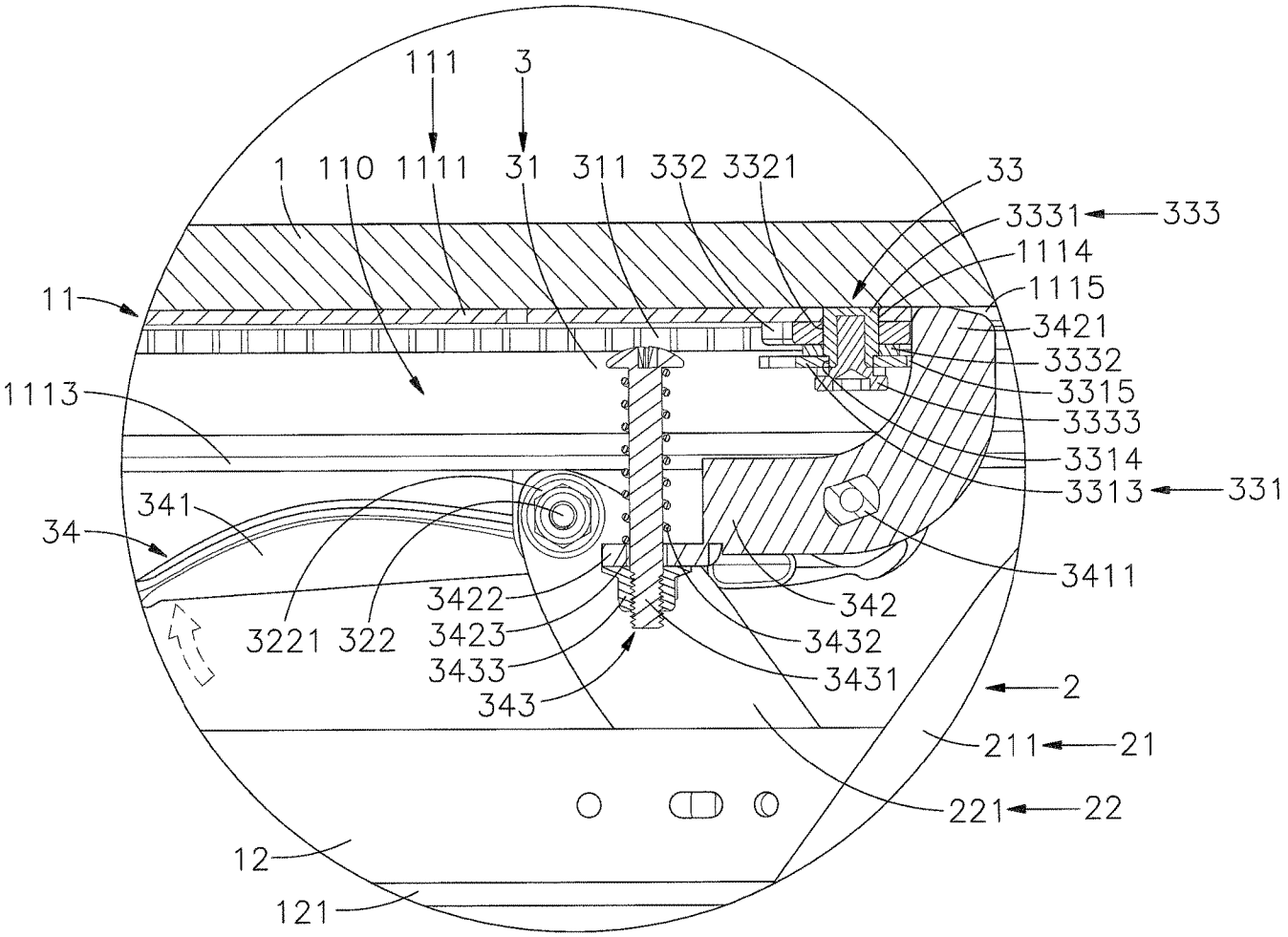
FIG. 8 is an enlarged view of a part of FIG. 7
Figure 9:
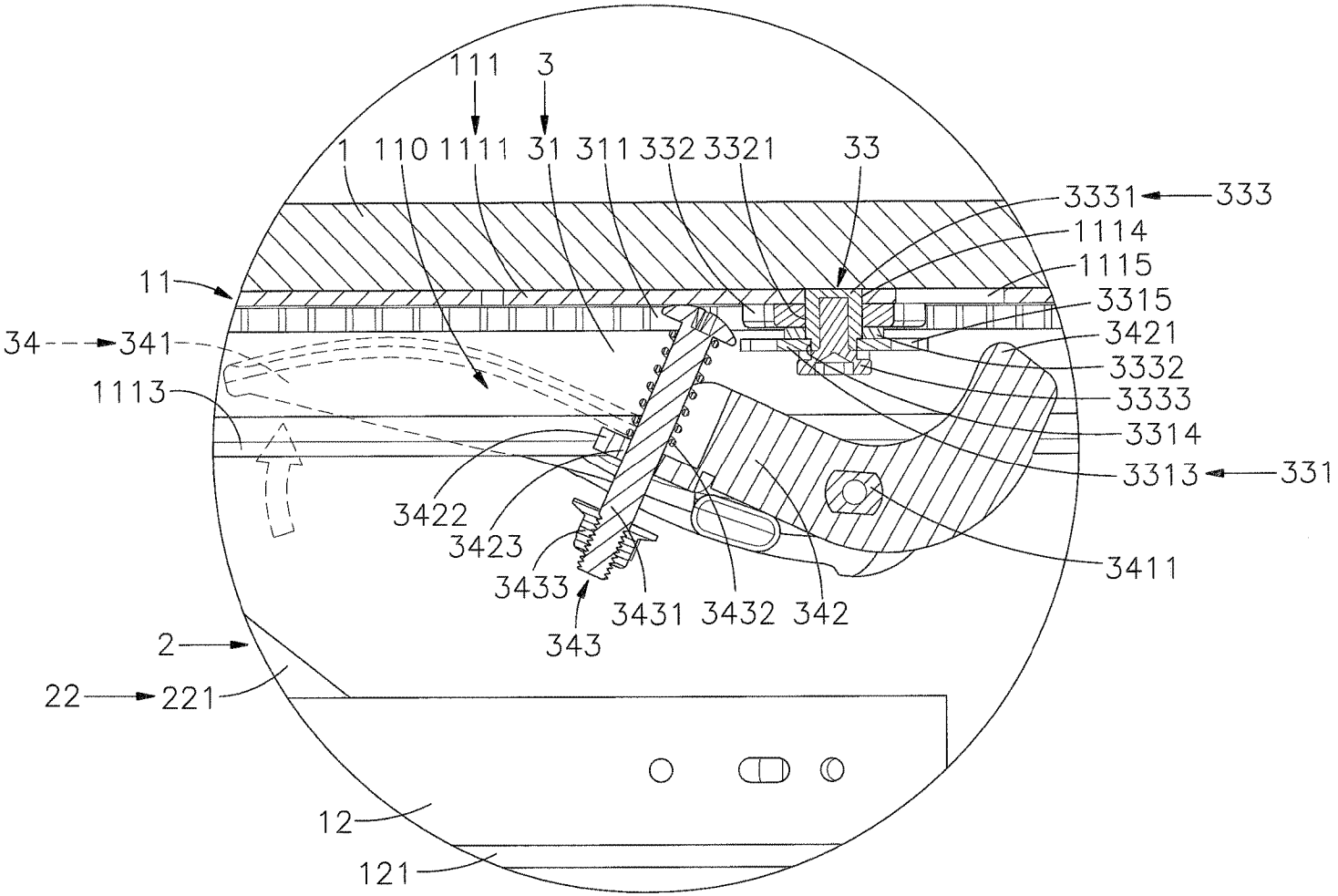
FIG. 9 is similar to FIG. 8, illustrating the locking member biased and disengaged from the associating center gear.
Figure 10:
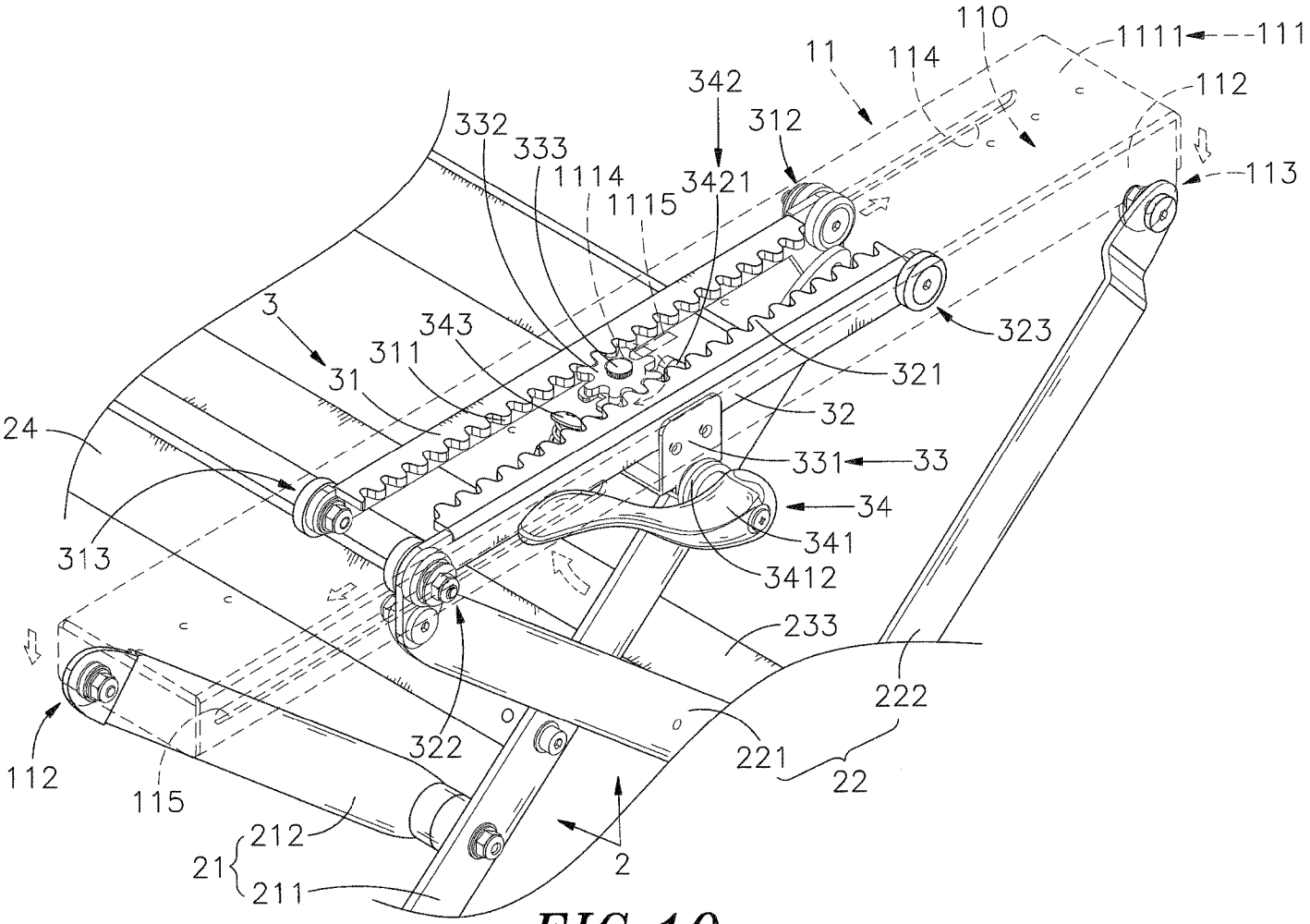
FIG. 10 is a schematic perspective view of a part of the present invention, illustrating the operating handle operated and the locking member biased and disengaged from the associating center gear.
Figure 11:
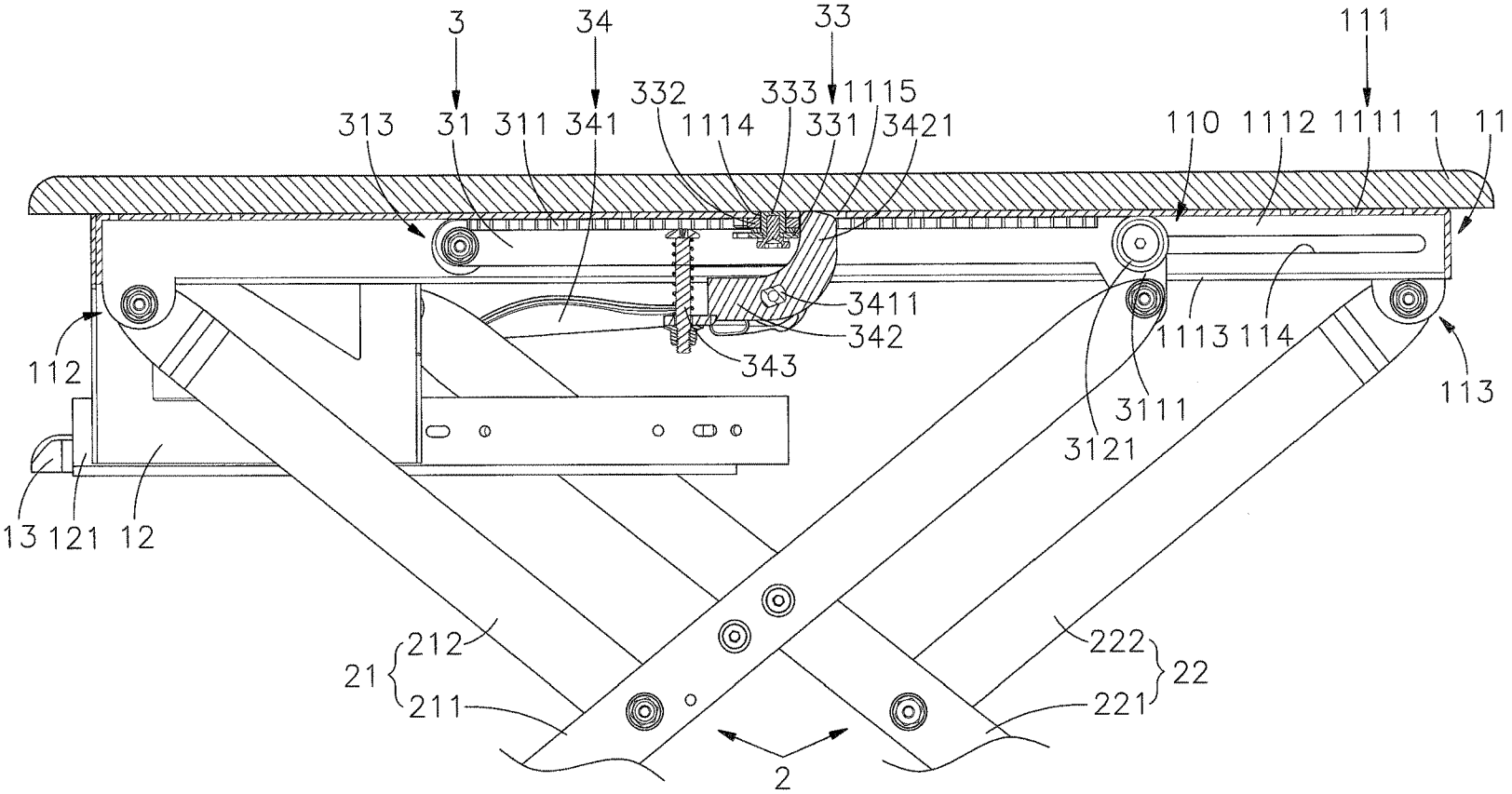
FIG. 11 corresponds to FIG. 7, illustrating the elevation of the table top adjusted.
Figure 12:
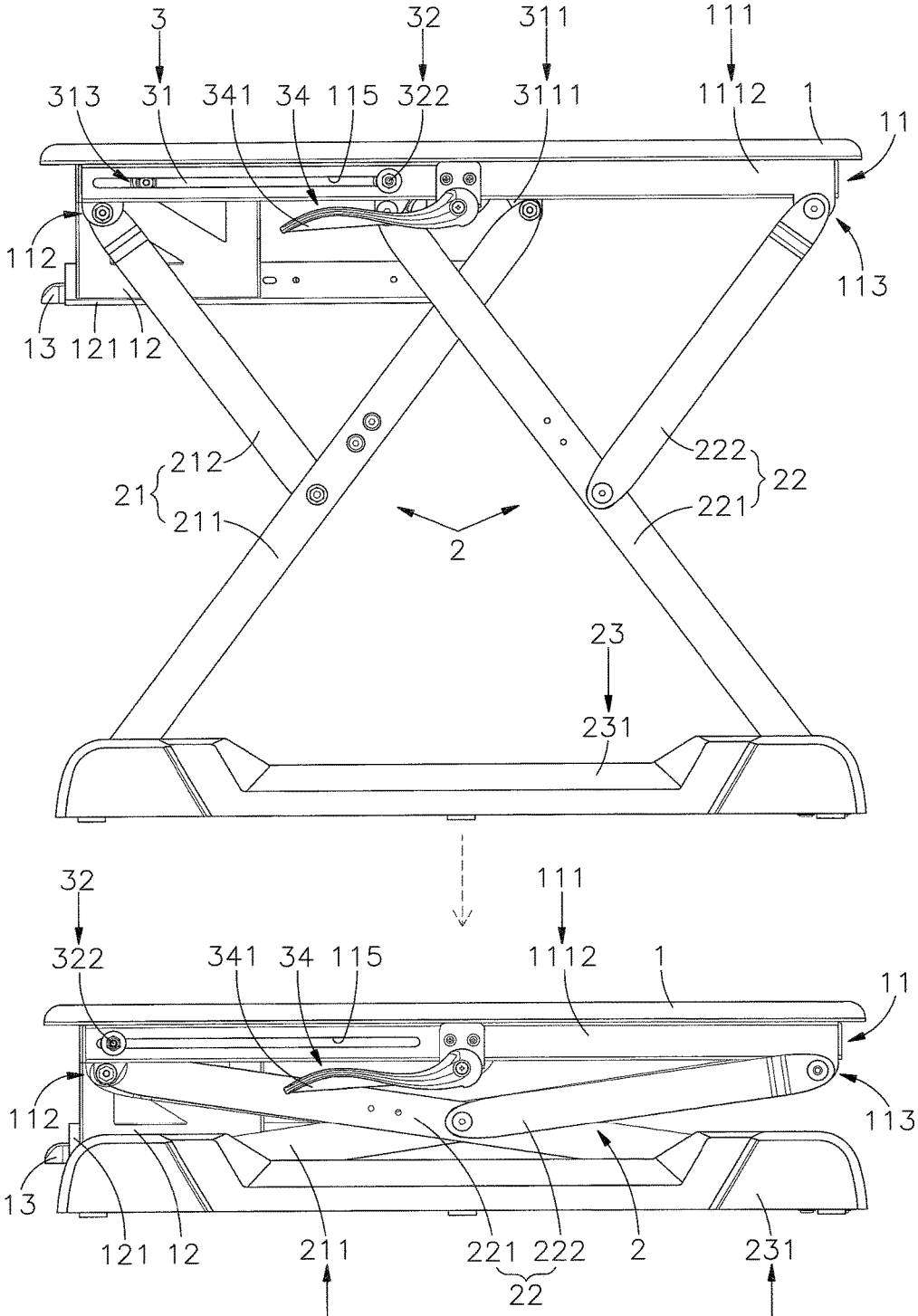
FIG. 12 is a schematic operational view illustrating the height-adjustable table set between the extended position and the collapsed position.

Referring to FIGS. 7-12, when adjusting the elevation of the table top 1, operate the grips 341 of the operating handles 34 of the lifting control mechanism 3 to compress the respective torsion springs 3412 and simultaneously to rotate the respective shanks 3411 in direction toward the bottom surface of the table top 1, thereby disengaging the hook tips 3421 of the respective locking members 342 from the respective center gears 332 and the retaining notches 3315 of the respective base frames 331 to unlock the first linkages 21 and the second linkages 22 of the linkage mechanism 2. At the same time, the bearing end pieces 3422 of the respective locking members 342 are forced to compress the respective compression springs 3432 of the buffer means 343. At this time, impart a downward or upward pressure to the table top 1 to extend out or receive the first linkages 21 and the second linkages 22 of the linkage mechanism 2 and to move the table top 1 to the desired elevation.

During the action of the first linkages 21 and the second linkages 22, the first strut rods 212 and the second strut rods 222 are biased relative to the respective first pivot holders 112 and the second pivot holders 113 of the support block units 11, the first legs 211 and the second legs 221 are biased relative to the respective hollow bottom block units 23 to perform the action of an isosceles linkage mechanism; the first legs 211 and the second legs 221 are biased to compress the respective torsion springs 2313, and the first sliding tooth racks 31 and the second sliding tooth racks 32 are respectively driven by the first legs 211 and the second legs 221 to move inwardly or outwardly in the respective sliding open chambers 110 of the respective support block units 11 so that the toothed portions 311, 321 drive the center gears 332 of the lock mechanisms 33 to rotate, and thus, the first guide rods 312 and the second guide rods 322 are moved in the respective first sliding slots 114 and the second sliding slots 115 of the support block units 11, the rollers 3121, 3221 and the rotary members 313, 323 are rotated along the respective horizontal bottom panels 1113 of the position-limiting rail blocks 111, facilitating the center gears 332 to move the first sliding tooth racks 31 and the second sliding tooth rack 32 in the reversed directions and enabling the table top 1 to be moved with the linkage mechanism 2 to the desired elevation.

After adjusted the table top 1 to the desired elevation, release the hands from the grips 341 of the respective operating handles 34, enabling the grips 341 to be biased downwardly to their previous position by the elastic restoring energy of the torsion springs 3412 and the compression springs 3432 of the buffer means 343, and thus, the hook tips 3421 of the respective locking members 342 are forced into engagement with the respective center gears 332. At this time, the hook tips 3421 of the locking members 342 are respectively positioned in the respective retaining notches 3315 of the respective base frames 331 and upwardly engaged into the respective elongated positioning holes 1115 of the respective position-limiting rail blocks 111 to stop the respective center gears 332 from rotation. Since the center gears 332 are respectively engaged with the respective toothed portions 311 of the respective first sliding tooth racks 31 and the respective toothed portions 321 of the respective second sliding tooth racks 32, the first sliding tooth racks 31 and the second sliding tooth racks 32 are prohibited from sliding movement along the respective position-limiting rail blocks 111. Further, the locked first linkages 21 and the second linkages 22 can firmly support the table top 1 in the adjusted position. The arrangement of the lifting control mechanism 3 on the two support block unit 11 of the table top 1 allows operation of the operating handles 34 to lock or unlock the linkage mechanism 2 so that the first linkages 21 and the second linkages 22 can be easily and rapidly set between the extended or collapsed position and the table top 1 can be easily and rapidly adjusted to the desired elevation.

In the present preferred embodiment, the two sets of first sliding tooth racks 31 and the second sliding tooth racks 32 of the lifting control mechanism 3 are mounted in the respective support block units 11 of the table top 1 at two opposite lateral sides in a symmetric relationship; the center gears 332 of the lock mechanisms 33 are engaged with the respective first sliding tooth racks 31 and the respective second sliding tooth racks 32; when forcing the table top 1 downward to receive the first linkages 21 and the second linkages 22 of the linkage mechanism 2 or lifting the table top 1 to extend out the first linkages 21 and the second linkages 22 of the linkage mechanism 2, the first sliding tooth racks 31 and the second sliding tooth racks 32 of the lifting control mechanism 3 are moved inward or outward along the respective sliding open chambers 110 of the respective support block units 11, and the center gears 332 are rotated to move the first sliding tooth racks 31 and the second sliding tooth racks 32 in reversed directions, and thus the displacement stroke of the first linkages 21 and the second linkages 22 is reduced by one-half, accelerating the speed of the upward or downward adjustment of the table top 1. Further, since the first linkages 21 and the second linkages 22 are arranged in two sets and symmetrically disposed at the opposing left and right sides, the linkage mechanism 2 can be received in a flat condition in the hollow bottom block units 23 to reduce the overall dimension of the table for delivery or storage.

In conclusion, the first linkages 21 and the second linkages 22 of the linkage mechanism 2 are respectively pivotally connected to the two support block units 11 of the table top 1; the first sliding tooth racks 31 and the second sliding tooth racks 32 of the lifting control mechanism 3 are respectively pivotally connected to the first linkages 21 and the second linkage 22 and slidably mounted in the respective support block units 11 of the table top 1; the center gears 332 of the lock mechanisms 33 are respectively engaged with the first sliding tooth racks 31 and the second sliding tooth racks 32; the user can operate the grips 341 of the operating handles 34 to disengage the respective locking members 342 from the respective center gears 332 for allowing vertical movement of the table top 1 to extend out or receive the first linkages 21 and the second linkage 22 so that the center gears 332 can be rotated to move the first sliding tooth racks 31 and the second sliding tooth racks 32 in the reversed directions, facilitating adjustment of the elevation of the table top 1.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A height-adjustable table, comprising:

a table top comprising two support block units located on a bottom surface thereof and respectively extended along two opposite short sides thereof in a parallel manner, each said support block unit comprising a position-limiting rail block having a sliding open chamber defined therein, a first pivot holder and a second pivot holder respectively located at opposing front and rear sides in a diagonal relationship;

a linkage mechanism comprising two first linkages and two second linkages respectively and pivotally connected to said first pivot holders and said second pivot holders of said support block units, each said first linkage comprising a first leg, each said second linkage comprising a second leg; and a lifting control mechanism comprising two first sliding tooth racks and two second sliding tooth racks respectively slidably mounted in said sliding open chamber of said two support block unit and respectively pivotally coupled to said first leg and said second leg, two lock mechanisms respectively mounted between said two first sliding tooth racks and said two second sliding tooth racks and an operating handle mounted at each said lock mechanism, each said lock mechanism comprising a base frame and a center gear rotatably mounted in said base frame and meshed with one said first sliding tooth rack and one said second sliding tooth rack, each said operating handle comprising a grip suspending outside one respective said support block unit, a shank perpendicularly extended from one end of said grip and pivotally coupled to said base frame of one respective said lock mechanism and a locking member fastened to a distal end of said shank remote from said grip and adapted for locking said center gear, said grip being operable to bias said locking member in direction away from said center gear for allowing said table top to be moved upward or downward by an external force in extending out or collapsing said first linkages and said second linkages so that said center gears are rotated to move said first sliding tooth racks and said second sliding tooth racks in the respective position-limiting rail blocks in reversed directions, wherein said position-limiting rail block of each said support block unit comprises a top panel, two side panels respectively downwardly extended from two opposite lateral sides of said top panel, said first pivot holder and said second pivot holder respectively located at said two side panels at opposing front and rear sides in a diagonal relationship, and a first sliding slot and a second sliding slot respectively located at said two side panels and respectively disposed remote from said first pivot holder and said second pivot holder in a diagonal relationship; said first sliding tooth racks of said lifting control mechanism each comprise a first guide rod and said second sliding tooth racks of said lifting control mechanism each comprise a second guide rod respectively, said first guide rods and said second guide rods of said lifting control mechanism being respectively slidably inserted through said first sliding slots and said second sliding slots of said position-limiting rail blocks of the respective support block units.

2. The height-adjustable table as claimed in claim 1, wherein said position-limiting rail block of each said support block unit comprises a mounting through hole located on the center of said top panel; said base frame of each lock mechanism comprises a flat flange perpendicularly and outwardly extended from one upright side wall thereof and inserted into an inside of said position-limiting rail block of one respective said support block unit, a second axle hole located on said flat flange; each said lock mechanism of said lifting control mechanism further comprises a pivot connector, said pivot connector comprising a cap nut riveted to said mounting through hole of the respective position-limiting rail blocks, a screw upwardly inserted through said second axle hole of said base frame and a center gear and fastened up with said cap nut.

3. The height-adjustable table as claimed in claim 2, wherein each said support block unit further comprises an elongated positioning hole cut through said top panel thereof and disposed adjacent to said mounting through hole; a locking member of an operating handle of each said lock mechanism comprises a hook tip adapted for engaging into said elongated positioning hole of the respective support block units.

4. The height-adjustable table as claimed in claim 1, wherein said position-limiting rail block of each said support block unit further comprises two horizontal bottom panels respectively extended from respective bottom sides of said side panels thereof in direction toward each other; said first sliding tooth racks and said second sliding tooth racks of said lifting control mechanism each further comprise a connection lug extended from one end thereof out of the respective support block unit and pivotally connected to a first leg of a first linkage or a second leg of a second linkage, and a roller rotatably mounted on said first guide rod or said second guide rod and supported inside said position-limiting rail block of the respective support block units.

5. The height-adjustable table as claimed in claim 1, wherein the said position-limiting rail block of each said support block unit further comprises two horizontal bottom panels respectively extended from respective bottom sides of said side panels thereof in direction toward each other; said first sliding tooth rack and said second sliding tooth rack each further comprise a rotary member pivotally mounted at an opposite end thereof remote from said first guide rod or said second guide rod.

6. The height-adjustable table as claimed in claim 1, wherein said table top further comprises two brackets respectively downwardly extended from said position-limiting rail blocks of said support block units at an inner side, and two sliding rails respectively mounted in said two brackets in parallel and horizontally movable in and out of the respective said-brackets, and a supplementary table top plate mounted on said sliding rail and movable with said sliding rail in and out of said table top.

7. The height-adjustable table as claimed in claim 1, wherein each said first linkage further comprises a first strut rod pivotally connected with one end thereof to a middle part of said first leg and with an opposite end thereof to said first pivot holder of one respective said support block unit; each said second linkage further comprises a second strut rod pivotally connected with one end thereof to a middle part of said second leg and with an opposite end thereof to said second pivot holder of one respective said support block unit.

8. The height-adjustable table as claimed in claim 1, wherein said linkage mechanism further comprises two hollow bottom block units respectively coupled with said first linkages and said second linkages at a bottom side in a parallel manner to face toward the respective support block units of said table top, each said hollow bottom block unit comprising a hollow bottom block, a first pivot axle and a second pivot axle respectively and transversely mounted in opposing front and rear ends of said hollow bottom block and respectively pivotally coupled with an opposing bottom end of said first leg of the respective first linkages and an opposing bottom end of said second leg of the respective second linkages, and two torsion springs respectively mounted on said first pivot axle and said second pivot axle with respective opposite ends thereof respectively stopped against said hollow bottom block and said first leg or said second leg.

9. The height-adjustable table as claimed in claim 1, wherein the said base frame of each said lock mechanism comprises two upright side walls, an accommodation space defined between said two upright side walls for the passing of said second sliding tooth rack, one said upright side wall being affixed to said support block unit, two first axle holes respectively located on said two upright side walls near a bottom side thereof, a flat flange perpendicularly and outwardly extended from a top side of the other said upright side wall to an inside of said position-limiting rail block of the respective support block units, and a second axle hole located on said flat flange and extended in a direction perpendicular to the extending direction of said first axle hole; each said lock mechanism further comprises a pivot connector pivotally connecting said center gear to said second axle hole of said base frame of the respective lock mechanisms.

10. The height-adjustable table as claimed in claim 9, wherein said base frame of each said lock mechanism comprises a retaining notch located on a border edge of said flat flange thereof; said locking member of each said lock mechanism comprises a hook top extended from one end thereof for engaging in said retaining notch of said base frame and said center gear.

11. The height-adjustable table as claimed in claim 1, wherein said operating handle of each said lock mechanism further comprises a torsion spring mounted on said shank with two opposite ends thereof respectively stopped against said base frame and said grip; said locking member of said operating handle of each said lock mechanism comprises a hook top extended from one end thereof for engaging in a retaining notch of said base frame and said center gear, a bearing end piece located at an opposite end thereof and a through hole cut through said bearing end piece; said operating handle of each said lock mechanism further comprises a buffer means, said buffer means comprising a headed pusher rod slidably inserted through said through hole of said locking member, a screw nut threaded onto said headed pusher rod and abutted at a bottom side of said bearing end piece of said locking member, and a compression spring mounted on said headed pusher rod and stopped between said bearing end piece of said locking member and the head of said headed pusher rod.

* * * * *